US008919595B2

(12) United States Patent
Chae

(10) Patent No.: US 8,919,595 B2
(45) Date of Patent: Dec. 30, 2014

(54) CLOSURE AND CONTAINER HAVING THE SAME CLOSURE

(76) Inventor: Dong-Seuk Chae, Gyeonggi-do (KR)

( * ) Notice: Subject to any disclaimer, the term of this patent is extended or adjusted under 35 U.S.C. 154(b) by 10 days.

(21) Appl. No.: 13/379,423

(22) PCT Filed: Jun. 18, 2010

(86) PCT No.: PCT/KR2010/003957

§ 371 (c)(1),
(2), (4) Date: Dec. 20, 2011

(87) PCT Pub. No.: WO2010/151009

PCT Pub. Date: Dec. 29, 2010

(65) Prior Publication Data

US 2012/0103993 A1 May 3, 2012

(30) Foreign Application Priority Data

Jun. 22, 2009 (KR) ..... 10-2009-0055409

(51) Int. Cl.

| | |
|---|---|
| ***B65D 45/00*** | (2006.01) |
| ***B65D 45/32*** | (2006.01) |
| ***B65D 47/28*** | (2006.01) |
| ***B65D 47/06*** | (2006.01) |
| ***B65D 47/12*** | (2006.01) |
| ***B65D 47/24*** | (2006.01) |

(52) U.S. Cl.

CPC ..... *B65D 47/283* (2013.01); *B65D 47/063* (2013.01); *B65D 47/128* (2013.01); *B65D 47/243* (2013.01)

USPC ..... 220/315; 220/319; 215/274

(58) Field of Classification Search

CPC ..... B65D 45/00; B65D 43/162; B65D 2543/00092; B65D 45/16; B65D 51/18; B55D 45/32; B65F 1/1615

USPC ..... 220/315, 319, 320; 215/274, 275, 277, 215/280

See application file for complete search history.

(56) References Cited

U.S. PATENT DOCUMENTS 3,952,901 A * 4/1976 Conti ..... 215/251
4,359,166 A * 11/1982 Dubach ..... 215/272

(Continued)

FOREIGN PATENT DOCUMENTS

JP 02563125 B2 9/1996
JP 09-501375 A 2/1997

(Continued)

OTHER PUBLICATIONS

International Search Report for International Application No. PCT/KR2010/003957.

*Primary Examiner* — Anthony Stashick
*Assistant Examiner* — Jennifer N Zettl
(74) *Attorney, Agent, or Firm* — LRK Patent Law Firm

(57) ABSTRACT

A closure and a container having the same closure are provided. The closure includes a sealing portion assembled to an aperture of a container to seal the container; a plurality of locking protrusions, each lock protrusion connected to a hinge extending from a lower rim of the sealing portion to protrude inwards and fixed to a locking flange formed on the container; a cover portion having a ring shape and assembled to an outside of the sealing portion to be vertically movable with respect to the sealing portion; and a plurality of fixing protrusions protruding from an inner circumferential surface of the cover portion to support the locking protrusions.

7 Claims, 14 Drawing Sheets

(56) References Cited

U.S. PATENT DOCUMENTS

| | | | | |
|---|---|---|---|---|
| 4,366,921 | A * | 1/1983 | Kirk, Jr. | 222/153.09 |
| 4,519,514 | A | 5/1985 | Agbat et al. | |
| 5,314,084 | A * | 5/1994 | Folta et al. | 215/249 |
| 5,678,718 | A * | 10/1997 | Morris et al. | 220/254.1 |
| 5,788,100 | A * | 8/1998 | Sturk | 215/258 |
| 5,927,529 | A * | 7/1999 | Hofmann et al. | 215/223 |
| 5,957,314 | A * | 9/1999 | Nishida et al. | 215/249 |
| 6,158,604 | A * | 12/2000 | Larguia et al. | 215/217 |
| 6,328,174 | B1 * | 12/2001 | Marangoni Graziani et al. | 215/249 |
| 7,401,706 | B2 * | 7/2008 | Shingle | 215/220 |
| 7,845,505 | B2 * | 12/2010 | Hamamoto et al. | 215/277 |
| 7,878,354 | B2 * | 2/2011 | Chae | 215/301 |
| 8,225,949 | B2 * | 7/2012 | Aneas | 215/249 |
| 2009/0139953 | A1 * | 6/2009 | Py | 215/247 |
| 2010/0243599 | A1 * | 9/2010 | Chae | 215/274 |

FOREIGN PATENT DOCUMENTS

| | | | |
|---|---|---|---|
| KR | 20-0394215 | Y1 | 9/2005 |
| WO | WO 2007148916 | A1 * | 12/2007 |

* cited by examiner

CLOSURE AND CONTAINER HAVING THE SAME CLOSURE

TECHNICAL FIELD

The present invention relates to a closure and a container having the same closure, and more particularly, to a closure, which is used in a container containing liquid such as water, beverage, etc. is conveniently used by just one touch opening/closing scheme and ensures excellent airtightness, and a container having the same closure.

BACKGROUND ART

A container for storing beverages, powder or other contents is generally provided with a closure which is required to have a variety of functions depending on the usage of the container or the contents to be stored in the container.

For example, a carbonated drink container should keep its internal pressure over the atmospheric pressure, so it is important to maintain the airtightness of its closure during the distribution procedure.

In case of a container with a relatively larger capacity, it is preferred that the container has a closure which can be conveniently resealed after the closure is opened, so that the contents remaining in the container can be stored without deterioration. For example, a cork closure ensures excellent airtightness but has some inconvenience in that the cork closure may not be easily opened.

As another example, a screw top frequently used for general beverage containers is inconvenient because the screw top should be rotated. In particular, many children are inexperienced in rotating the screw top to open or close the container, so they may feel inconvenience in using the screw top.

The screw top should be strongly fastened in order to prevent contents from leaking out. In this case, however, the fastened screw top may not be easily opened again. To the contrary, if the screw top is not so tightly closed that the screw top can be easily opened again, the contents of the container may be leaked out.

In order to solve the above problems, the inventor of the present invention has proposed a closure structure ensuring convenient use, as disclosed in Korean Patent No. 10-575259 (issued on Apr. 24, 2006), Korean Patent No. 10-757795 (issued on Sep. 5, 2007) and Korean Utility Model Registration No. 20-385497 (issued on May 21, 2005). The closures as disclosed in the above documents can be opened or closed by just one touch, so that they can be more conveniently used in comparison to a screw top.

Technical Problem

Accordingly, the present invention is conceived to improve the conventional closure structures. Therefore, the present invention is directed to providing a closure and a container having the same closure, which may ensure sufficient airtightness as well as convenient use even if the contents are stored in a container under a predetermined pressure.

Technical Solution

In one aspect of the invention, there is provided a closure, which includes a sealing portion assembled to an aperture of a container to seal the container; a plurality of locking protrusions, each lock protrusion being connected to a hinge extending from a lower rim of the sealing portion to protrude inwards and fixed to a locking flange formed on the container; a cover portion having a ring shape and assembled to an outside of the sealing portion to be vertically movable with respect to the sealing portion; and a plurality of fixing protrusions protruding from an inner circumferential surface of the cover portion to support the locking protrusions.

In another aspect of the present invention, there is also provided a container, which includes a container body having a locking flange protruding from an outer circumferential surface of an aperture of the container body; and a closure coupled to the aperture to seal the container, wherein the closure includes: a sealing portion assembled to an aperture of a container to seal the container body; a plurality of locking protrusions, each lock protrusion being connected to a hinge extending from a lower rim of the sealing portion to protrude inwards and fixed to a locking flange formed on the container body; a cover portion having a ring shape and assembled to an outside of the sealing portion to be vertically movable with respect to the sealing portion; and a plurality of fixing protrusions protruding from an inner circumferential surface of the cover portion to support the locking protrusions.

Advantageous Effects

If the closure or the container having the same closure according to the present invention is used, the closure may be opened or closed by just one touch by means of relative upward and downward movements of the sealing portion and the cover portion, thereby ensuring convenient manipulation as well as excellent airtightness.

BEST MODE

Hereinafter, embodiments of the present invention will be described in detail with reference to the accompanying drawings.

Figure 1:
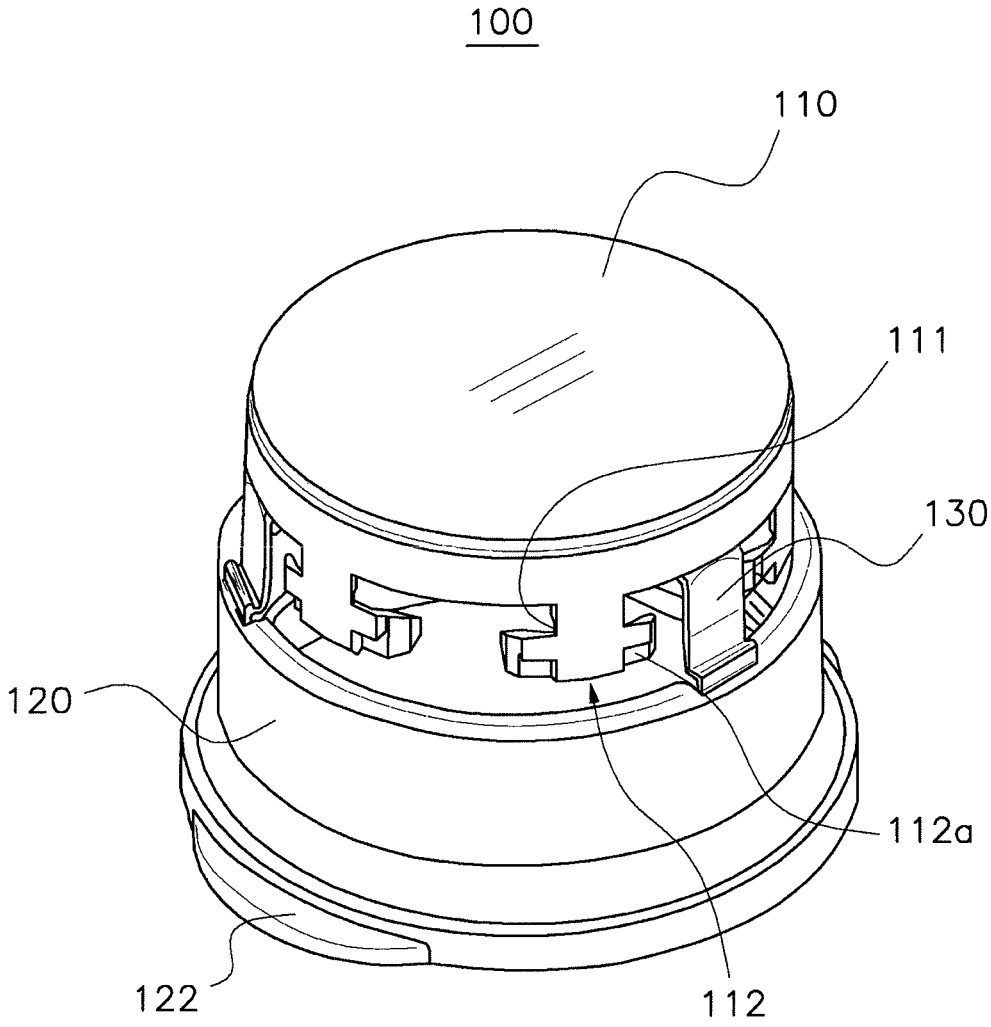
FIG. 1 is a perspective view showing the entire configuration of a closure according to the present invention.

Referring to FIG. 1, a closure according to the present invention may be made of a resin material as a whole by an injection molding. The closure includes a sealing portion 110 assembled to surround an aperture of a container for airtightness, and a cover portion 120 assembled to an outside of the sealing portion 110 to be vertically movable with respect to the sealing portion 110.

A lower end of the sealing portion 110 is connected to an upper end of the cover portion 120 by means of a coupling band 130 shaped as a thin strip, and the coupling band is so thin that the coupling band may be folded.

The sealing portion 110 has a plurality of locking protrusions 112 which are configured to be rotationally symmetrical so that the locking protrusions 112 may be fixed to a locking flange formed on the container. The number of the locking protrusions 112 may be suitably determined in consideration of the size of the closure, the degree of airtightness, etc.

Each locking protrusion 112 is connected to a hinge 111 extending from a lower rim of the scaling portion 110, and configured to protrude inwards.

The hinge 111 is thinner in comparison to its locking protrusion 112 so each locking protrusion 112 may be rotated about its corresponding hinge 111 served as the rotational axis.

Each locking protrusion 112 may have a groove 112*a* which is inwardly concaved at a lower end of the locking protrusion, wherein a fixing protrusion 121 formed on an inside of the cover portion 120 is supported by the groove 112*a*.

The cover portion 120 may have a gripping protrusion 122 which protrudes outwards at a lower end of an outer circumferential surface of the cover portion 120 so that a user may easily grip the cover portion 120 upon the opening or closing operation of the closure. Preferably, two gripping protrusions may be located to be opposite to each other.

For reference, FIG. 1 shows a state in which the sealing portion is entirely withdrawn from the cover portion, for the purpose of illustrating the entire configuration of the closure according to the present invention. The opening or closing operation of the closure may be performed while the sealing portion has been inserted into the cover portion, as will be explained in detail below with reference to other drawings.

Figure 2:
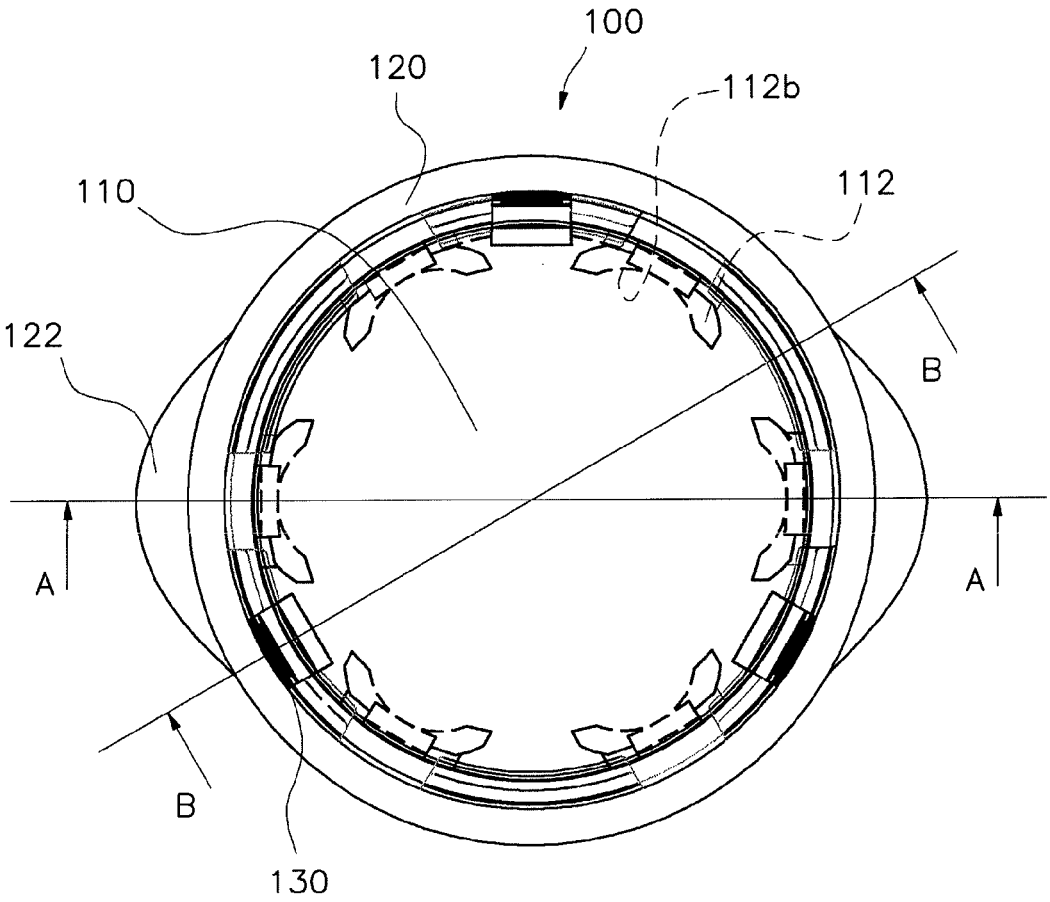
FIG. 2 is a plane view showing the closure according to the present invention.

Referring to FIG. 2, the locking protrusions 112 provided at the lower end of the sealing portion 110 are fixed to the locking flange formed on the container, and each locking protrusion 112 preferably has a concavely curved surface 112*b* which would face the locking flange of the container, so that the locking protrusions 112 may be easily elastically deformed when the locking protrusions 112 are fixed to or released from the locking flange.

Figure 3:
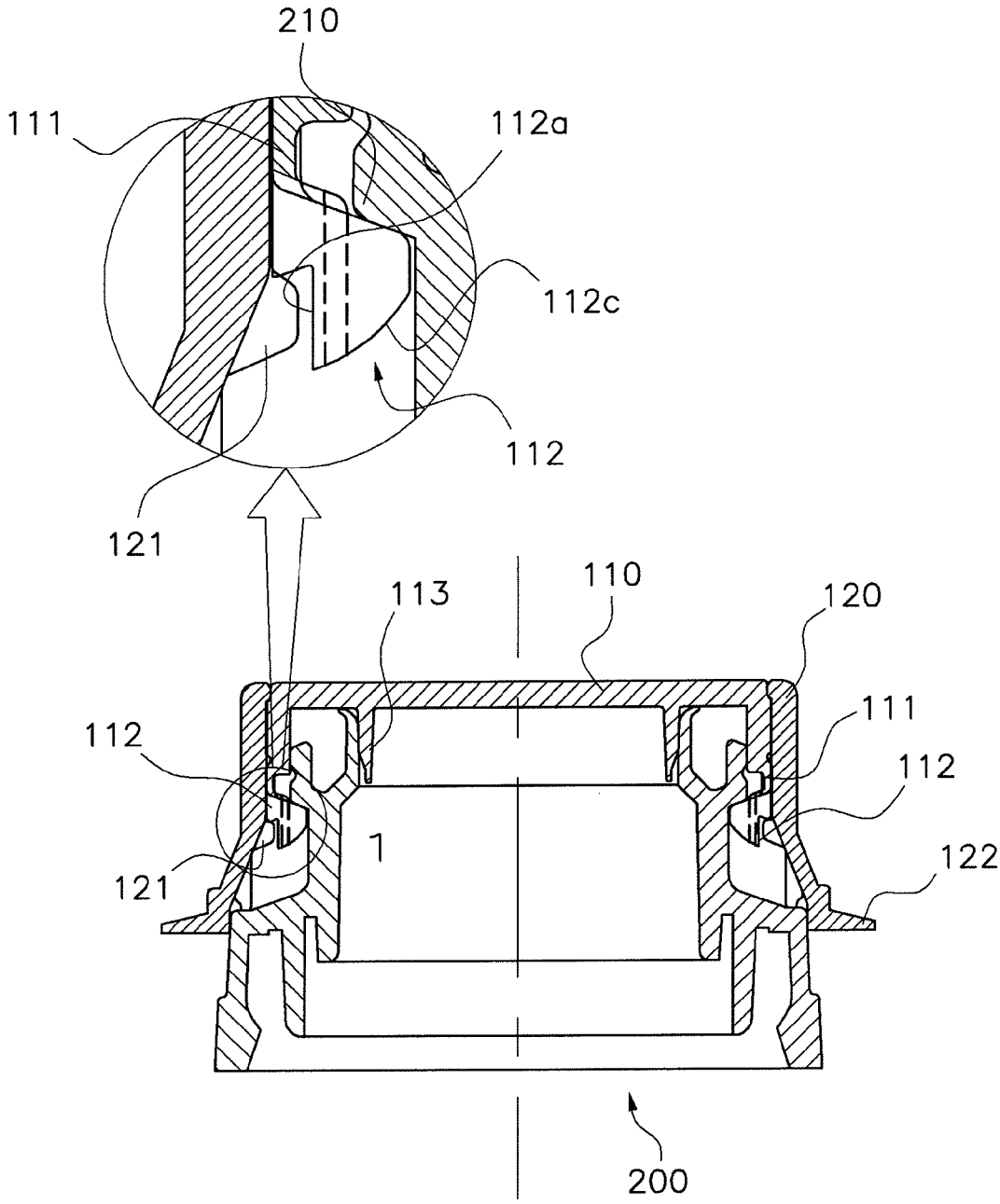
FIG. 3 is a sectional view taken along the line A-A of FIG. 2.

FIG. 3 shows a state in which the closure is assembled to a container so that the closure comes into a closed state, wherein the locking protrusions 112 at the lower end of the sealing portion 110 are locked to the locking flange 210 of the container 200, so the container may maintain its airtight state. At this time, the upper end of the sealing portion 110 coincides with the upper end of the cover portion 120, so that the upper end of the sealing portion 110 is flush with the upper end of the cover portion 120.

Each fixing protrusion 121 of the cover portion 120 which is located outside the sealing portion 110 is seated into its corresponding groove II 2*a* at the lower end of its corresponding locking protrusion 112, so that all the locking protrusions 112 may not be widened outwards but firmly fixed to the locking flange 210 of the container 200.

A lower inner surface of each locking protrusion 112 is composed of an inclined surface 112*c*, so that the inclined surface 112*c* prevents each locking protrusion 112 from being locked by the locking flange 210 of the container while allowing the closure to be assembled.

A rib 113 may be additionally formed on a lower surface of the sealing portion 110 so that the rib 113 may be inserted into the aperture of the container to increase the airtight state.

The cover portion 120 is fittingly assembled to an outside of the sealing portion 110 so that the cover portion 120 may be moved upwards and downwards with respect to the sealing portion 110, and the upward and downward operation between the sealing portion 110 and the cover portion 120 allows the closure to be opened or closed.

It is preferable that a gap between the cover portion 120 and the sealing portion 110 is configured to be minimized as long as the cover portion 120 and the sealing portion 110 can be easily moved upwards and downwards with respect to each other.

Figure 4:
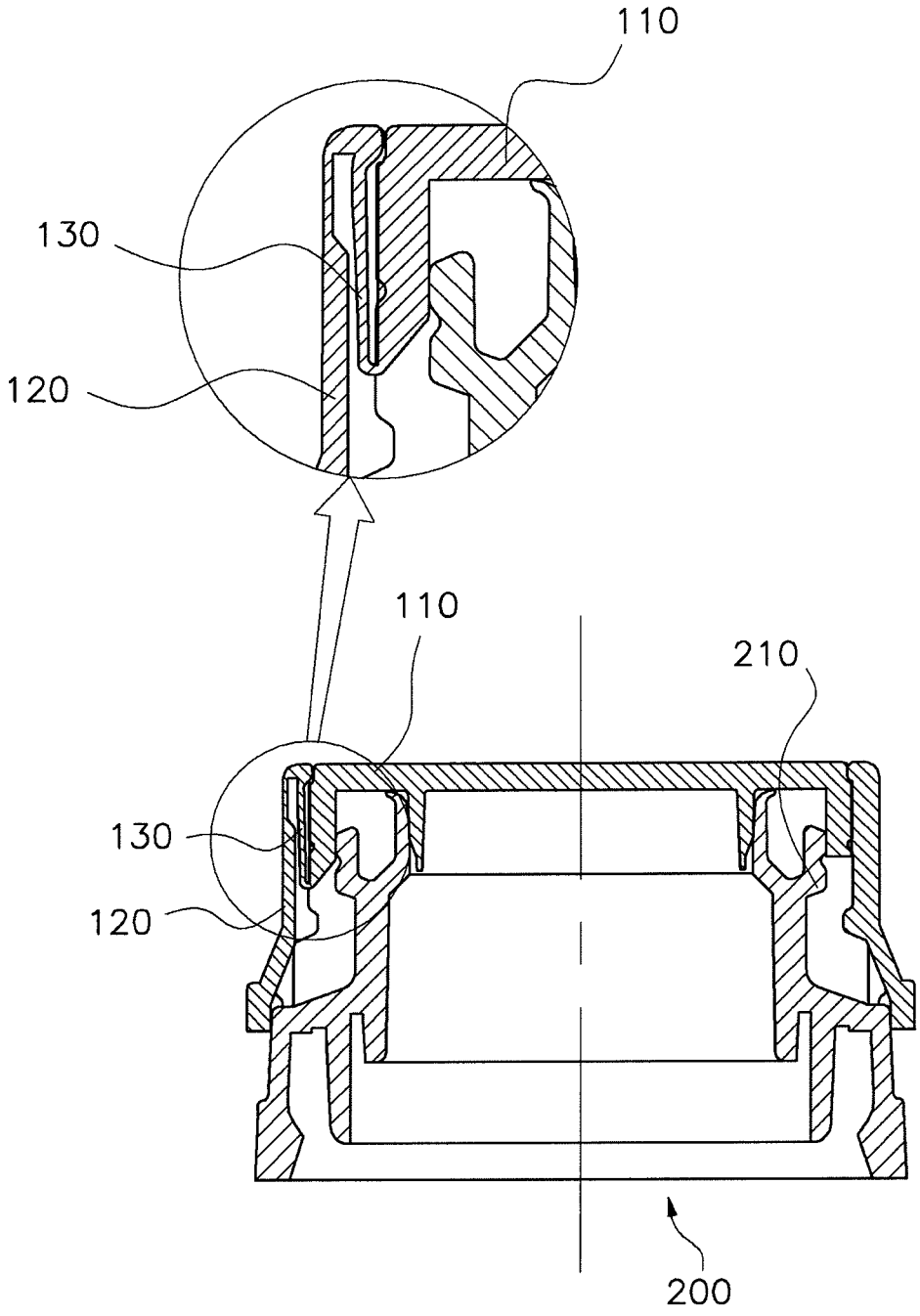
FIG. 4 is a sectional view taken along the line B-B of FIG. 2.

As shown in FIG. 4, the coupling band 130 shaped as a thin strip is provided between the upper end of the cover portion 120 and the lower end of the sealing portion 110, so that the cover portion 120 and the sealing portion 110 are connected to each other to be rolled into one. The coupling band is so thin that the coupling band 130 may be folded without disturbing the relative upward and downward movement between the cover portion and the sealing portion.

Hereinafter, the simple usage of the closure according to the present invention as configured above will be described.

Figure 5:
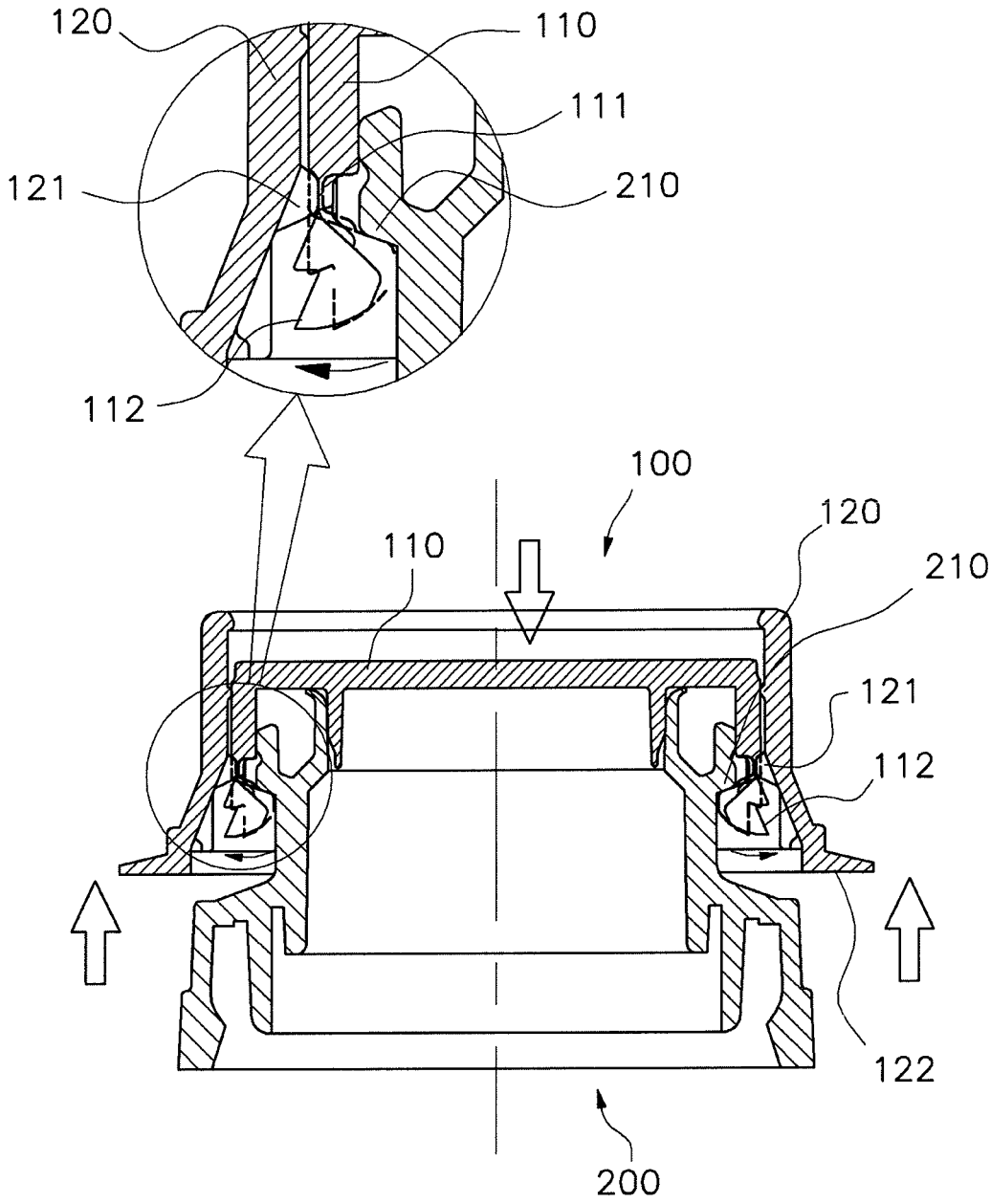
FIGS. 5 and 6 are sectional views illustrating an opening procedure of the closure according to the present invention.

As shown in FIG. 5, if a user grips the gripping protrusion 122, move the cover portion 120 upwards and presses the sealing portion 110 from above while the closure 100 is assembled to the container 200, the fixing protrusions 121 supporting their corresponding locking protrusions 112 are moved upwards along with the cover portion 120 as the cover portion 120 is moved upwards. At this time, as the fixing protrusions 121 move over their corresponding locking protrusions 112, the locking protrusions 112 which would have been fixed to the locking flange 210 of the container 200 are widened outwards with respect to the hinge 111 served as the axis, so that the closure 100 may be opened.

Meanwhile, if a user pulls up only the cover portion 120 without pressing and fixing the sealing portion 110 in order to open the closure, both the cover portion 120 and the sealing portion 110 should be moved upwards in a state that the locking protrusions 112 have been supported by the fixing protrusions 121. However, since the locking protrusions 112 are supported by the fixing protrusions 121 at this time, the locking protrusions 112 may not be easily separated from the locking flange 210.

Thus, if a user pulls up only the cover portion without pressing and fixing the sealing portion in order to open the closure, the closure may not be opened. To the contrary, the closure may be opened only through its normal opening manipulation in which both the sealing portion and the cover portion are simultaneously manipulated as explained above. In this way, the closure according to the present invention serves as a safe closure which may be opened only through the normal opening manipulation of the closure as explained above.

Figure 6:
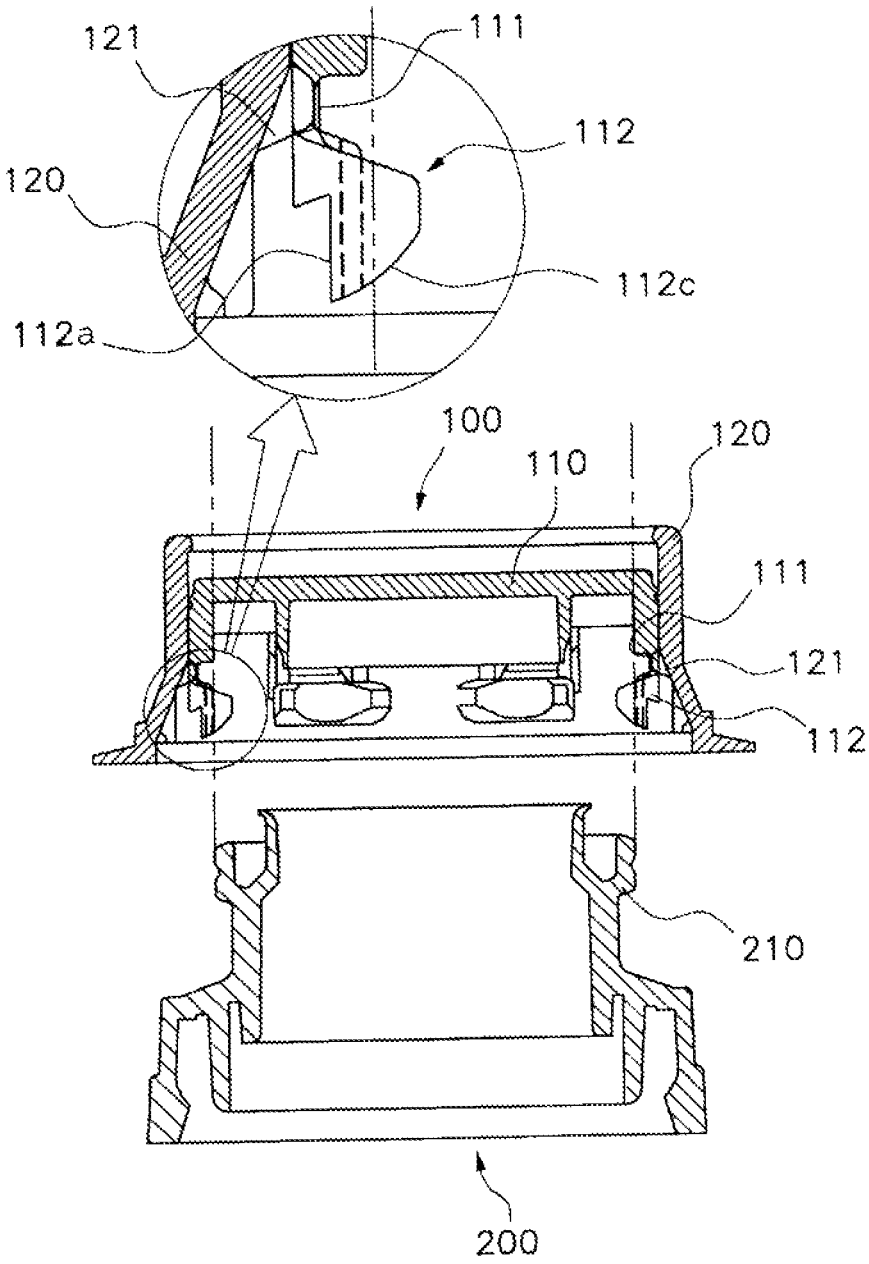

Now, FIG. 6 shows a state in which the closure is opened, wherein each fixing protrusion 121 is located outside its corresponding hinge 111. At this time, the upper end of the sealing portion 110 is located below the upper end of the cover portion 120.

The closure may be assembled to the container by pressing the closure over the container. At this time, while the upper end of the locking flange 210 of the container is in contact with the inclined surface 112*c* which corresponds to the lower surface of each locking protrusion 112, each locking protrusion 112 moves over the locking flange 210 of the container to be fixed thereto. Simultaneously, the cover portion 120 is moved downwards, and each fixing protrusion 121 is inserted into its corresponding groove 112*a* of the locking protrusion 112. As such, each fixing protrusion 121 supports the locking protrusion 112 to prevent each locking protrusion 112 from being widened outwards, so that the container may be closed (see FIG. 5).

FIGS. 7 to 10 show exemplary modifications of the locking protrusion which may be employed in the closure according to the present invention.

Figure 7:
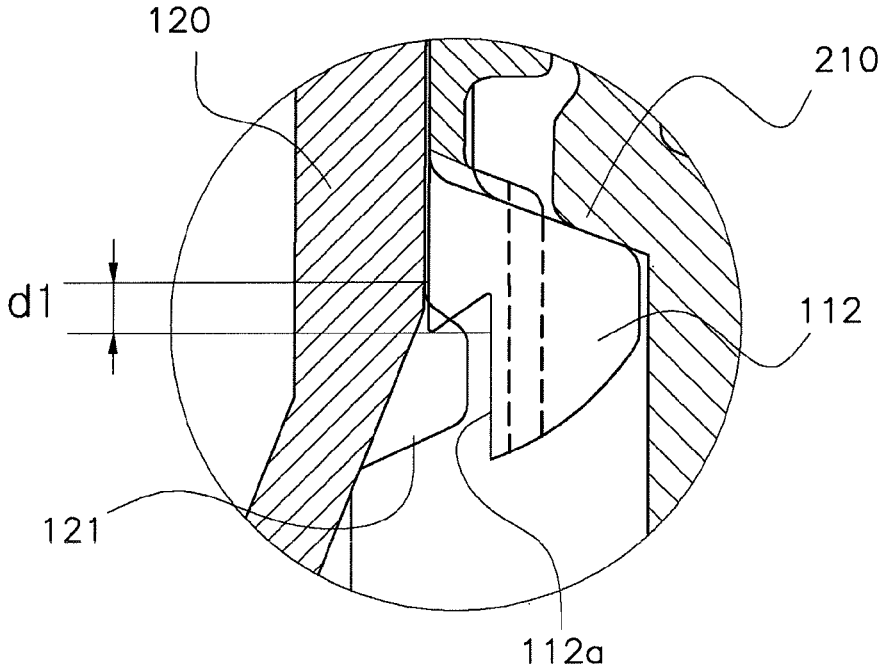
FIGS. 7 to 10 are views illustrating exemplary modifications of a locking protrusion employed in the closure according to the present invention.

FIG. 7 is an enlarged view showing a portion of a locking protrusion shown in FIG. 3. As explained above, if a user moves the cover portion upwards and simultaneously presses the sealing portion in order to open the closure, the closure may be opened.

In this opening procedure, the fixing protrusion 121 supporting the locking protrusion 112 moves upwards from the groove 112*a* of the locking protrusion 112, so that the fixing protrusion 121 may be separated from the groove 112*a*. During this opening procedure, the fixing protrusion 121 and the locking protrusion 112 are compressed and elastically deformed.

Accordingly, in order to open the closure, a larger manipulating force is required in the displacement d1 as far as the fixing protrusion 121 is entirely separated from the groove 112*a* of the locking protrusion 112.

Figure 8:
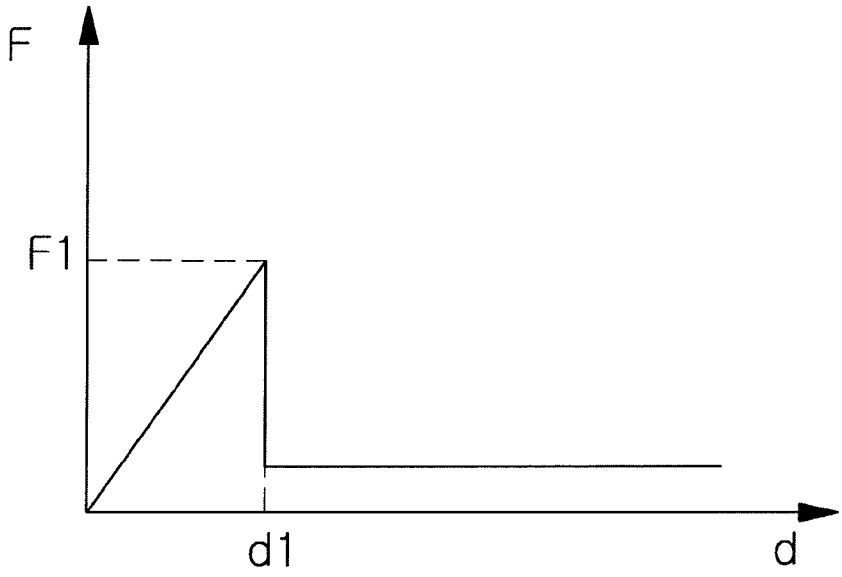

FIG. 8 is a graph for briefly illustrating a relation between the manipulating force F and the vertical displacement d between the cover portion and the sealing portion while the closure having the locking protrusion as shown in FIG. 7 is opened. Here, a user needs a larger manipulating force F1 up to the vertical displacement d1 in order to open the closure.

As explained above, the manipulating force required for opening the closure may be determined by depending on the size of the fixing protrusion (the degree of protrusion) and the depth of the groove of the locking protrusion, etc., and therefore the manipulating force may be selected in accordance with the usage of the closure. For example, if the content of the container has a larger inner pressure like carbonated beverages, the closure is preferably designed not to be easily opened. In this case, the size of the fixing protrusion and the depth of the groove of the locking protrusion, etc. may be selected to require a larger manipulating force. Otherwise, the number of the fixing protrusions and the number of the locking protrusions in the closure may be increased.

Figure 9:
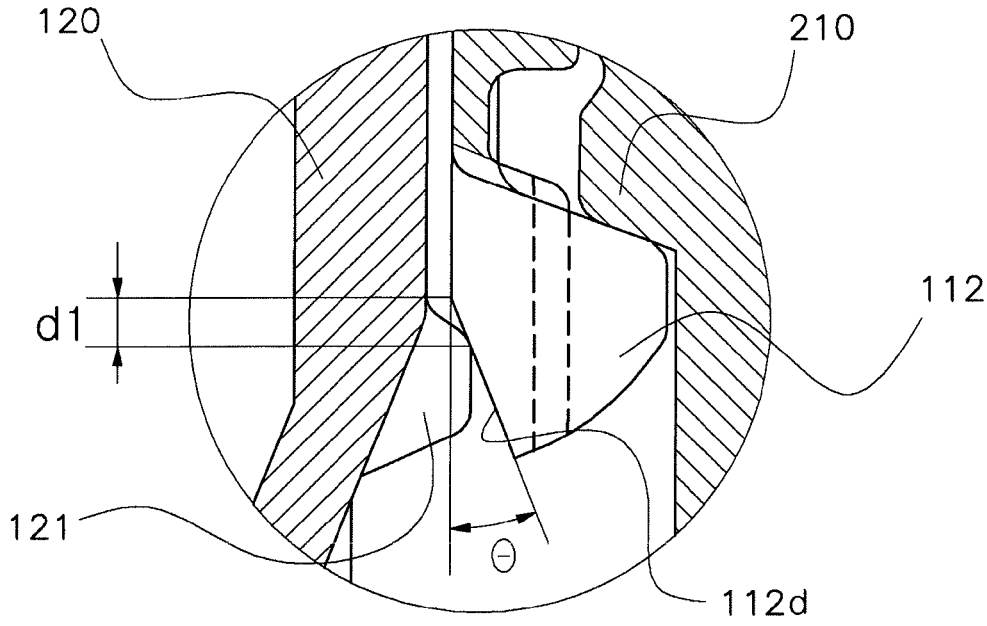

FIG. 9 shows one exemplary modification of the locking protrusion which may be employed in the closure according to the present invention. In the closure of the present invention, the locking protrusion 112 may have an inclined surface 112*d* which is inclined with respect to a vertical direction at the lower end of the locking protrusion 112, wherein the fixing protrusion 121 is supported by the inclined surface 112*d*.

Figure 10:
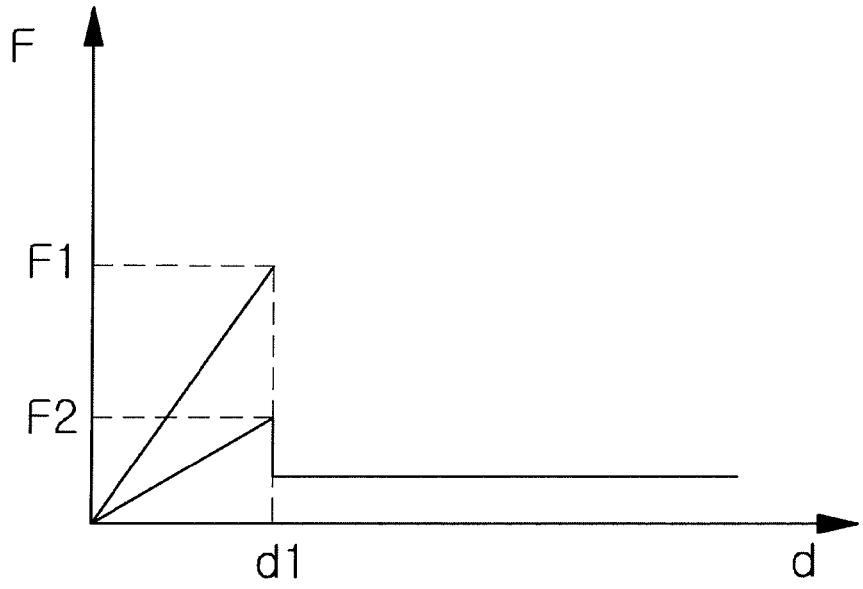

FIG. 10 is a graph for briefly illustrating a relation between the manipulating force F and the vertical displacement d between the cover portion and the sealing portion while the closure having the locking protrusion as shown in FIG. 9 is opened. Here, since the fixing protrusion 121 is moved along the inclined surface of the locking protrusion 112 during the opening procedure, a user may open the closure with a relatively smaller manipulating force F2 up to the vertical displacement d1 which correspond to a border line of the inclined surface, in comparison to the exemplary modification shown in FIG. 7.

As mentioned above, the magnitude of the manipulating force required for opening the closure may be varied depending on the shape of the locking protrusion, and therefore the manipulating force may be selected in accordance with the usage of the closure.

For example, if only easy opening/closing of the closure is considered as an important issue for the container, the container may be designed to be easily opened or closed just with a relatively smaller manipulating force as shown in the modification of FIG. 9. However, in case the container contains drugs or chemicals, which should not be easily opened by children, or contents with a relatively larger inner pressure such as carbonated beverages, the closure may be selected to require a larger manipulating force as shown in the modification of FIG. 7.

It has been illustrated that the magnitude of the manipulating force required for opening the closure may be varied by changing the shape of the locking protrusion with reference to FIGS. 7 and 9. However, additionally or alternatively, it would be obvious to those having ordinary skill in the art that the magnitude of the manipulating force required for opening the closure may be set in various ways by changing the size and/or the shape of the fixing protrusion.

Figure 11:
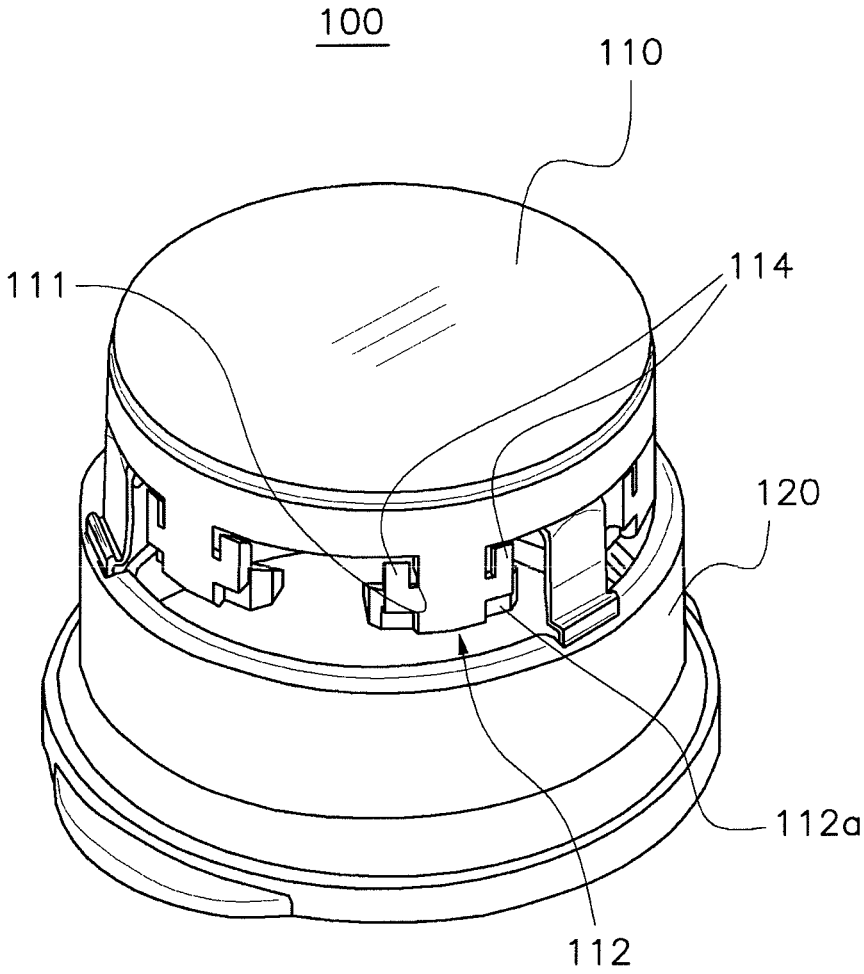
FIGS. 11 to 13 show another embodiment of the closure according to the present invention.
Figure 12:
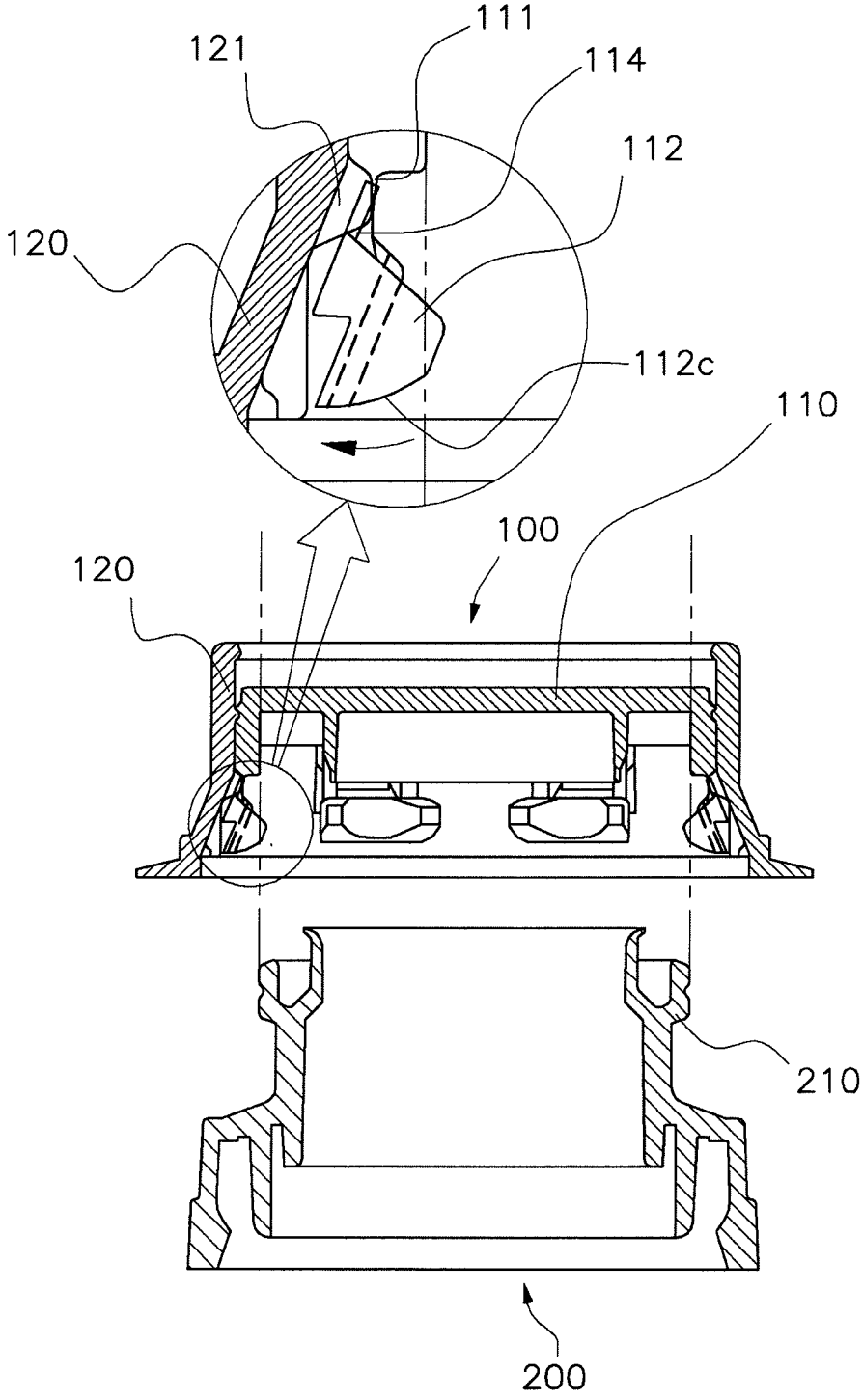
Figure 13:
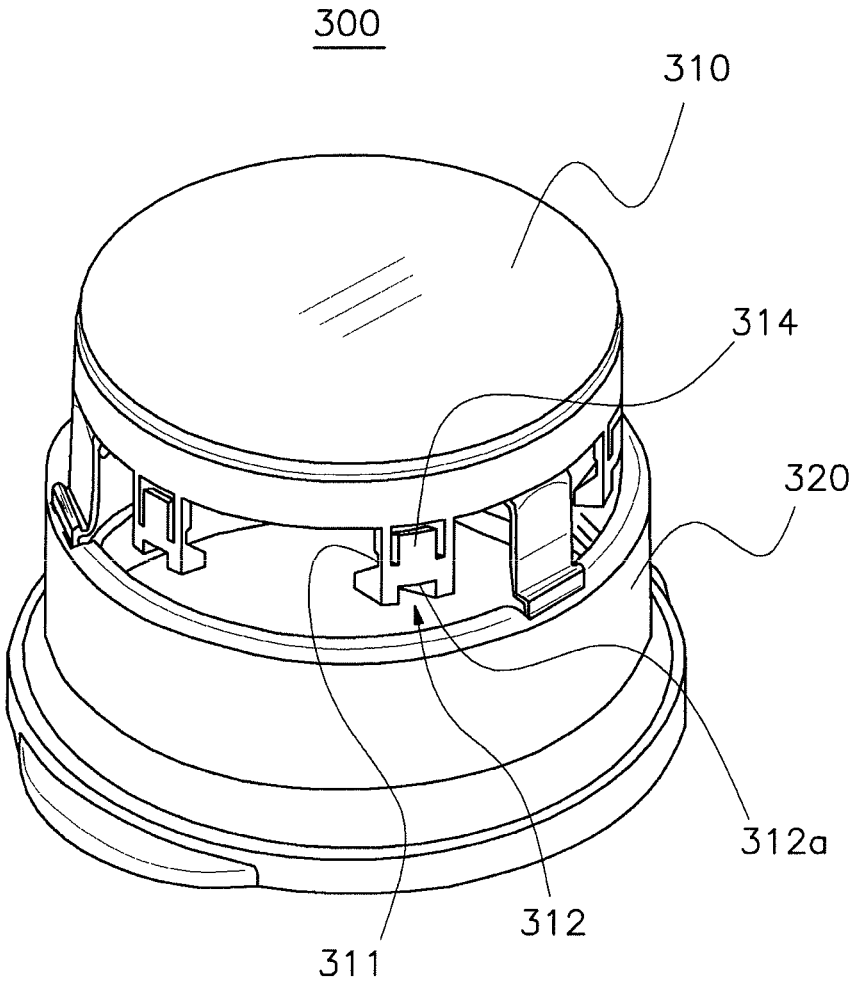

Now, FIGS. 11 to 13 show other embodiments of the closure according to the present invention. In the closure 100 according to the present invention, a lever protrusion 114 which protrudes upwards from the upper end of the locking protrusion 112 may be additionally provided.

As shown in FIG. 11, two lever protrusions 114 protrude upwards from upper ends of both sides of the locking protrusion 112 adjacent to the hinge 111.

After the closure is opened, each lever protrusion 114 may prevent any interference between the locking protrusion and the locking flange of the container during the reassembling process of the opened closure to the container, so that the closure may be easily reassembled to the container without any inconvenience.

For example, FIG. 6 shows that the locking protrusion 112 should not be folded inwards after the closure is opened. If the locking protrusion 112 is folded inwards, the locking protrusion 112 might be locked by the locking flange 210 of the container during the reassembling process of the opened closure, so the closure might not be closed.

Thus, the lever protrusion 114 allows the locking protrusion 112 to be permanently widened outwards after the closure is opened, so that the lever protrusion 114 may prevent any interference between the locking protrusion and the locking flange of the container during the reassembling process of the closure to the container, thereby preventing the closure from being incorrectly reassembled to the container.

More specifically, FIG. 12 shows that after the opening of the closure through the same procedure as explained above, the fixing protrusion 121 is located near the hinge so that the fixing protrusion 121 may allow the lever protrusion 114 to be pushed inwards and the locking protrusion 112 connected to the hinge 11*l* may be widened outwards.

Since the locking protrusion is permanently widened outwards after the opening of the closure as described above, the locking flange 210 of the container is always in contact with the inclined surface 112*c* in the lower end of the locking protrusion 112 during the reassembling process of the opened closure, so that the closure may be easily assembled to the container.

FIG. 13 shows an exemplary modification of the lever protrusion employed in the closure according to the present invention, wherein one lever protrusion 314 may protrude upward near the center of a locking protrusion 312 which is connected by two hinges 311.

A groove 312*a* into which the fixing protrusion may be inserted is formed near the lower end of the locking protrusion 312 to which the lever protrusion 314 is located. The opening or closing procedure of the closure is identical to the embodiments as described above. The sealing portion is denoted by the reference number 310 and the cover portion is denoted by the reference number 320.

Figure 14:
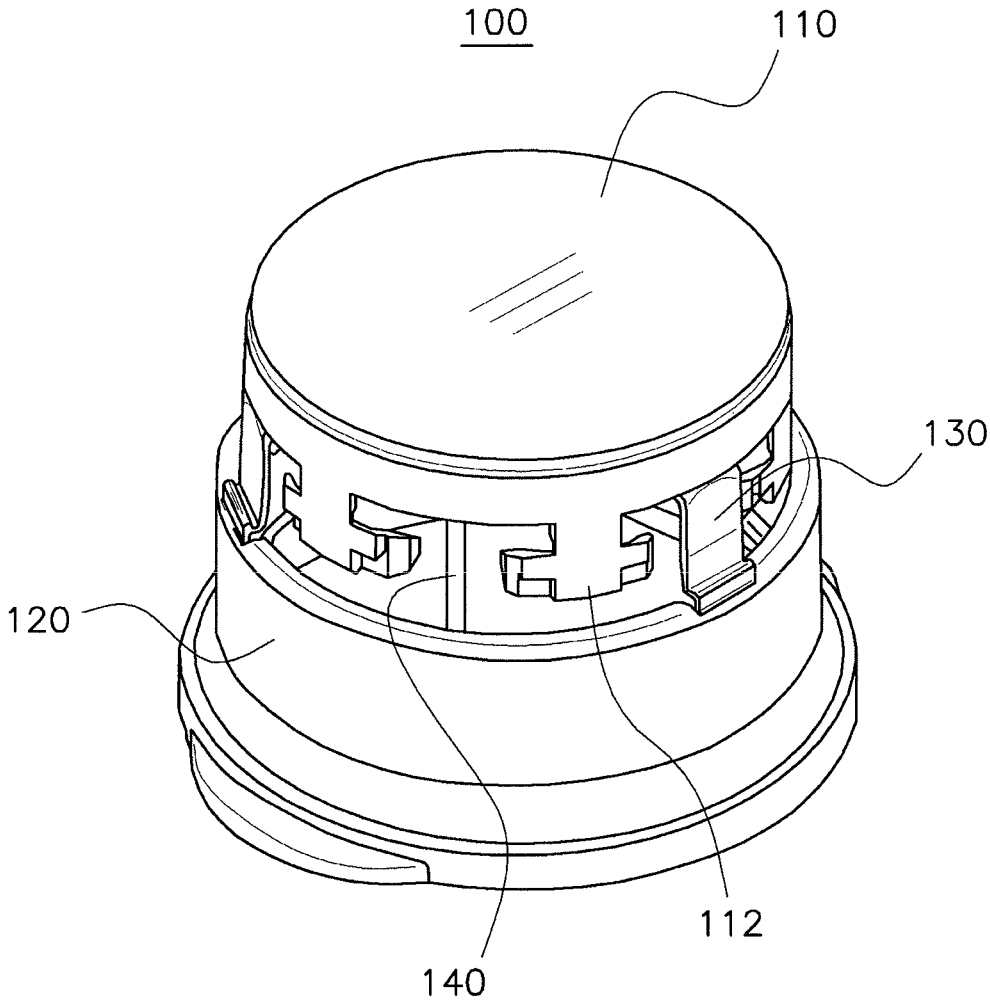
FIGS. 14 to 16 show still another embodiment of the closure according to the present invention.
Figure 15:
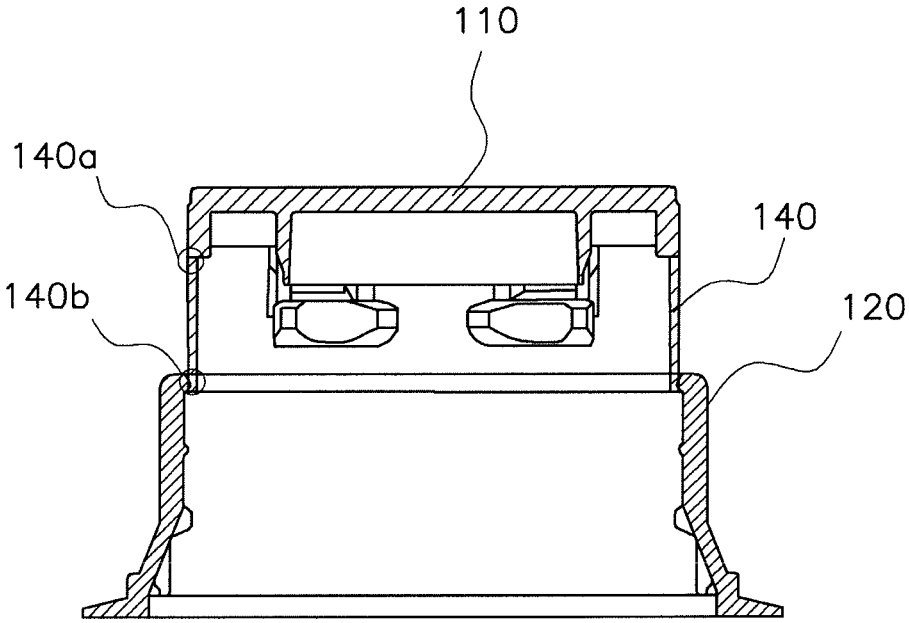
Figure 16:
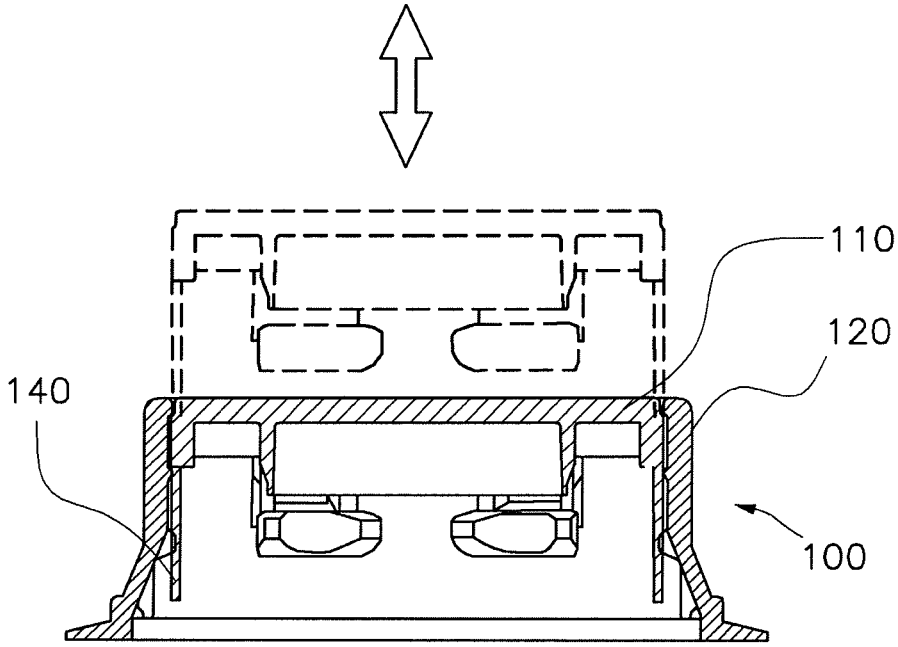

FIGS. 14 to 16 show still other embodiments of the closure according to the present invention.

As shown in FIG. 14, in the closure according to the present invention, at least two guide bars 140 may be additionally fixed to the lower rim of the sealing portion 110 in the vertical downward direction so that lower ends of the guide bars 140 may be brought into contact with an inner circumferential surface of the cover portion 120.

For reference, FIG. 14 shows an appearance of the closure manufactured by the injection molding as shown in FIG. 1. In the initially injection-molded state of the closure, the sealing portion 110 is located above. However, if the sealing portion 110 is coupled with the container to close the closure as explained above, the upper end of the sealing portion 110 is flush with the upper end of the cover portion 120 (see FIG. 3).

In the closure manufactured by the injection molding as shown in FIG. 14, the sealing portion and the cover portion are connected to each other by means of only the thin coupling band. Thus, if there is no additional auxiliary means for supporting the sealing portion and the cover portion, the weakness of the thin coupling band may cause the coupling band to be easily torn or damaged through the handling or transport procedure of the closure until the closure manufactured by the injection molding is assembled to the container.

Thus, the guide bars provided in the closure according to the present invention serve to prevent the coupling band from being damaged during the handling procedure of the closure until the closure manufactured as described above is assembled to the container and then to guide the relative upward and downward movement between the sealing portion and the cover portion after the closure is assembled to the container.

Referring to FIG. 15, through the injection molding, an upper end 140*a* of the guide bar 140 fixed to the sealing portion 110 may be so thick that the upper end 140*a* may be firmly fixed to the sealing portion 110, while a lower end 140*b* of the guide bar 140 fixed to the inner circumferential surface of the upper end of the cover portion 120 may be so thin that the lower end 140*b* may be weakly connected to the upper end of the cover portion 120 in comparison to the upper end 140*a*.

Meanwhile, in the initial assembling procedure of the injection-molded closure to the container, if the sealing portion 110 is strongly pressed downwards while the closure is provisionally assembled to the aperture of the container, the sealing portion 110 may be moved downwards and assembled to the container while the connection between the lower end 140*b* of the guide bar 140 and the cover portion 120 is broken down.

As shown in FIG. 16, after the closure is assembled to the container, the guide bar 140 may be moved vertically along with the sealing portion 110. Since the guide bar 140 is moved along the inner wall of the cover portion 120, the guide bar 140 makes up for a gap between the sealing portion and the cover portion, so that the guide bar 140 may perform the guiding function for facilitating the upward and downward movement of the sealing portion and the cover portion.

Figure 17:
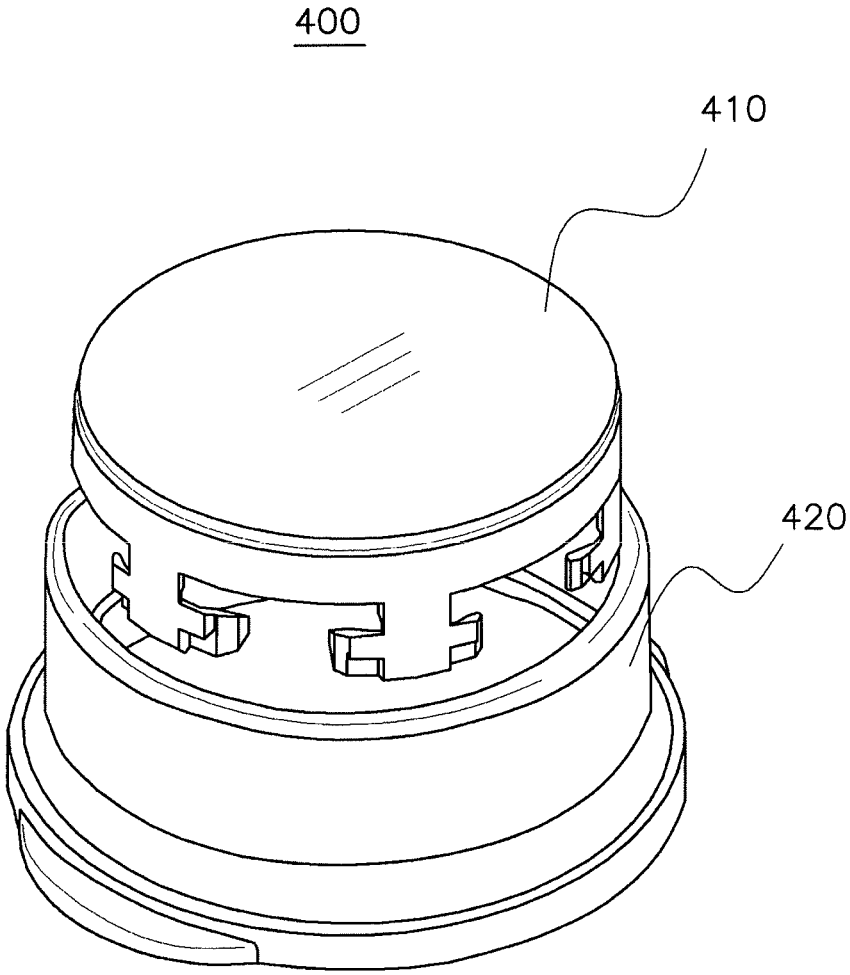
FIG. 17 shows another embodiment of the closure according to the present invention.

FIG. 17 shows a still further embodiment of the closure according to the present invention. Although the former embodiments illustrate that the sealing portion and the cover portion are connected to each other by means of the coupling band, the sealing portion and the cover portion need not to be connected by means of the coupling band in this embodiment.

It will be apparent to those having ordinary skill in the art that even if the sealing portion 410 and the cover portion 420 are manufactured by separate processes and then assembled into one unit as a closure as shown in FIG. 17, the closure may be operated in the same way as described in the former embodiments.

Meanwhile, an auxiliary band thinly connected between the cover portion and the coupling band may be additionally provided so that the auxiliary band may be broken down when the closure is initially opened by applying a manipulating force over a certain level.

A user may check whether the contents in the container have been already used or not by inspecting whether the auxiliary band is broken.

The above embodiments should be construed as only examples for illustrating the spirit of the present invention in detail, and therefore the scope of the present invention should not be limited to the drawings nor the embodiments.

What is claimed is:

1. A closure comprising:

a sealing portion assembled to an aperture of a container to seal the container;

a plurality of locking protrusions, each locking protrusion being connected to a hinge extending from a lower rim of the scaling portion to protrude inwards, being fixed to a locking flange formed on the container, and having a lever protrusion which protrudes upwards from an upper end of each locking protrusion;

a cover portion having a ring shape and assembled to an outside of the sealing portion to be vertically movable with respect to the sealing portion;

a plurality of fixing protrusions protruding from an inner circumferential surface of the cover portion to support the locking protrusions; and a plurality of coupling bands each shaped as a thin, foldable strip to connect an upper end of the cover portion and a lower end of the sealing portion to each other, wherein when the closure is opened, the fixing protrusion contacts the hinge which results in the lever protrusion being pushed inward while the locking protrusion widens outward.

2. The closure as claimed in claim 1, wherein the locking protrusion has a concavely curved surface which faces the locking flange.

3. The closure as claimed in claim 1, further comprising two gripping protrusions which protrude outwards at a lower end of an outer circumferential surface of the cover portion.

4. The closure as claimed in claim 1, wherein the locking protrusion has a groove at a lower end thereof, which supports the fixing protrusion.

5. The closure as claimed in claim 1, wherein the locking protrusion has an inclined surface at a lower end thereof, which supports the fixing protrusion, the inclined surface being inclined with respect to a vertical direction.

6. The closure as claimed in claim 1, wherein at least two guide bars are further fixed to the lower rim of the sealing portion in a vertical downward direction, whereby a lower end of the guide bar is brought into contact with the inner circumferential surface of the cover portion.

7. A container comprising;

a container body having a locking flange protruding from an outer circumferential surface of an aperture of the container body; and a closure coupled to the aperture to seal the container, wherein the closure includes:

a sealing portion assembled to an aperture of a container to seal the container body;

a plurality of locking protrusions, each locking protrusion being connected to a hinge extending from a lower rim of the sealing portion to protrude inwards, being fixed to a locking flange formed on the container body, and having a lever protrusion which protrudes upwards from an upper end of each locking protrusion;

a cover portion having a ring shape and assembled to an outside of the sealing portion to be vertically movable with respect to the sealing portion;

a plurality of fixing protrusions protruding from an inner circumferential surface of the cover portion to support the locking protrusions; and a plurality of coupling bands each shaped as a thin, foldable strip to connect an upper end of the cover portion and a lower end of the sealing portion to each other, wherein when the closure is opened, the fixing protrusion contacts the hinge which results in the lever protrusion being pushed inward while the locking protrusion widens outward.

* * * * *